US010251436B2

(12) United States Patent
Carter et al.

(10) Patent No.: US 10,251,436 B2
(45) Date of Patent: Apr. 9, 2019

(54) ARTICLE OF APPAREL WITH MATERIAL ELEMENTS HAVING A REVERSIBLE STRUCTURE

(71) Applicant: NIKE, Inc., Beaverton, OR (US)

(72) Inventors: Karin E. Carter, Portland, OR (US); ChiaPei C. Hung, Mt. Laurel, NJ (US); Rebecca P. Hurd, Tigard, OR (US); Dobriana Gheneva, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 560 days.

(21) Appl. No.: 13/679,541

(22) Filed: Nov. 16, 2012

(65) Prior Publication Data

US 2013/0074240 A1 Mar. 28, 2013

Related U.S. Application Data

(62) Division of application No. 11/254,547, filed on Oct. 19, 2005, now Pat. No. 8,336,117.

(51) Int. Cl.
*A41D 31/02* (2006.01)
*A41D 15/00* (2006.01)
(Continued)

(52) U.S. Cl.
CPC ..... *A41D 31/02* (2013.01); *A41D 15/005* (2013.01); *A41D 31/00* (2013.01); *D04B 1/24* (2013.01);
(Continued)

(58) Field of Classification Search
CPC ..... A41D 31/02; A41D 15/005; A41D 31/00; A41D 2400/20; A41D 2400/22;
(Continued)

(56) References Cited

U.S. PATENT DOCUMENTS 921,352 A 5/1909 Blaker et al.
1,282,411 A 10/1918 Golembiowski
(Continued)

FOREIGN PATENT DOCUMENTS

CA 2354389 A1 6/2000
FR 2846202 A1 4/2004
(Continued)

OTHER PUBLICATIONS

Jun. 8, 2017—(US) Office Action—U.S. Appl. No. 15/084,655.
Aug. 31, 2017—(US) Office Action—U.S. Appl. No. 15/084,655.

*Primary Examiner* — Alissa L Hoey
(74) *Attorney, Agent, or Firm* — Banner & Witcoff, Ltd.

(57) ABSTRACT

An article of apparel is disclosed that is at least partially formed from a material element having a substrate and a plurality of projections. The substrate has a first surface and an opposite second surface. The projections extend from the first surface of the substrate, and the projections each have terminal ends located opposite the substrate. The material element has a first permeability when the first surface has a convex configuration, and the material element has a second permeability when the first surface has a concave configuration, the first permeability being greater than the second permeability. The apparel may be reversible such that either the first surface or the second surface of the substrate faces outward.

12 Claims, 14 Drawing Sheets

(51) Int. Cl.
*A41D 31/00* (2019.01)
*D04B 1/24* (2006.01)
*D04B 21/20* (2006.01)

(52) U.S. Cl.
CPC ..... *D04B 21/207* (2013.01); *A41D 2400/20* (2013.01); *A41D 2400/22* (2013.01); *D10B 2403/0113* (2013.01); *D10B 2403/0213* (2013.01)

(58) Field of Classification Search
CPC ..... D04B 1/24; D04B 21/207; D10B 2403/0113; D10B 2403/0213
USPC ..... 2/4, 115, 69, 337, 336, DIG. 5; 442/197, 442/205, 225, 264, 356, 366; 28/163
See application file for complete search history.

(56) References Cited

U.S. PATENT DOCUMENTS 1,562,767 A 11/1925 Hess
1,788,731 A 1/1931 Mishel
2,259,560 A 10/1941 Glidden
2,344,811 A * 3/1944 Gill ..... 2/4
2,374,506 A 4/1945 Schorovsky
2,697,832 A 12/1954 Stich
2,771,661 A 11/1956 Foster
2,782,619 A 2/1957 Bialostok
2,851,390 A 9/1958 Chavannes
2,897,506 A 8/1959 Carter
2,897,508 A 8/1959 Bashore
3,158,518 A * 11/1964 Kessler ..... 156/72
3,219,514 A 11/1965 Otto
3,296,626 A 1/1967 Ludwikowski
3,334,006 A * 8/1967 Koller ..... 428/88
3,404,487 A * 10/1968 Johnson ..... 49/475.1
3,484,974 A * 12/1969 Culmone ..... 40/586
3,540,974 A * 11/1970 Broadhurst ..... 428/87
3,703,432 A 11/1972 Koski
3,723,231 A * 3/1973 Clay et al. ..... 428/86
3,856,598 A * 12/1974 Gregorian et al. ..... 156/85
3,922,410 A * 11/1975 Halloran ..... 428/88
3,935,043 A * 1/1976 Kessler ..... 156/72
3,973,065 A * 8/1976 Walsh et al. ..... 428/89
4,018,956 A * 4/1977 Casey ..... 428/86
4,076,881 A 2/1978 Sato
4,079,466 A 3/1978 Rosenstein
4,180,606 A 12/1979 Hance et al.
4,255,231 A * 3/1981 Boba et al. ..... 216/83
4,272,850 A 6/1981 Rule
4,322,858 A 4/1982 Douglas
4,408,356 A 10/1983 Abrams
4,438,533 A * 3/1984 Hefele ..... 2/97
4,536,431 A 8/1985 Wyckoff
4,538,301 A 9/1985 Sawatzki et al.
4,645,466 A * 2/1987 Ellis ..... 441/74
4,647,492 A 3/1987 Grant et al.
4,687,527 A * 8/1987 Higashiguchi ..... 156/72
4,690,847 A 9/1987 Lassiter et al.
4,712,252 A 12/1987 Chou et al.
4,716,594 A * 1/1988 Shannon ..... 2/4
4,810,559 A 3/1989 Fortier et al.
4,913,911 A 4/1990 Wildt
4,939,006 A * 7/1990 Nakajima et al. ..... 428/15
4,939,794 A * 7/1990 Aronson ..... 2/128
RE33,315 E 8/1990 Hisgen et al.
4,972,522 A 11/1990 Rautenberg
5,033,116 A 7/1991 Itagaki et al.
5,034,998 A 7/1991 Kolsky
5,052,053 A * 10/1991 Peart et al. ..... 2/2.16
5,112,426 A * 5/1992 Nakajima et al. ..... 156/250
5,133,516 A 7/1992 Marentic et al.
5,155,867 A 10/1992 Norvell
5,166,480 A * 11/1992 Bottger et al. ..... 181/292
5,210,877 A 5/1993 Newman
5,214,797 A * 6/1993 Tisdale ..... 2/455
5,271,101 A 12/1993 Speth et al.
5,337,418 A * 8/1994 Kato et al. ..... 2/456
5,380,578 A 1/1995 Rautenberg
5,381,558 A 1/1995 Lo
5,385,036 A * 1/1995 Spillane et al. ..... 66/87
5,486,385 A 1/1996 Bylund et al.
5,526,532 A 6/1996 Willard
5,561,860 A 10/1996 Nguyen-Senderowicz
5,600,850 A * 2/1997 Shannon ..... 2/69
5,626,949 A 5/1997 Blauer et al.
5,643,653 A 7/1997 Griesbach, III et al.
5,685,223 A 11/1997 Vermuelen et al.
5,787,503 A 8/1998 Murphy, III
5,794,266 A 8/1998 Han
5,806,093 A 9/1998 Summers
5,807,295 A * 9/1998 Hutcheon et al. ..... 602/42
5,809,567 A 9/1998 Jacobs et al.
5,817,394 A 10/1998 Alikhan et al.
5,836,016 A 11/1998 Jacobs et al.
5,887,280 A 3/1999 Waring
5,913,406 A 6/1999 Lofgren et al.
5,948,707 A 9/1999 Crawley et al.
5,951,931 A * 9/1999 Murasaki et al. ..... 264/167
5,957,692 A * 9/1999 McCracken ..... G09B 19/00 2/49.1
5,972,477 A 10/1999 Kim et al.
5,978,965 A 11/1999 Summers
5,983,395 A 11/1999 Lei
6,093,468 A 7/2000 Toms et al.
6,098,198 A 8/2000 Jacobs et al.
6,105,401 A * 8/2000 Chadeyron et al. ..... 66/195
6,116,059 A * 9/2000 Rock et al. ..... 66/191
6,145,348 A * 11/2000 Hardegree et al. ..... 66/192
6,199,410 B1 * 3/2001 Rock et al. ..... 66/195
6,247,215 B1 6/2001 Van Alboom et al.
6,295,654 B1 10/2001 Farrell
6,350,504 B1 * 2/2002 Alboom et al. ..... 428/88
6,393,618 B2 5/2002 Gameau
6,554,963 B1 4/2003 Botelho et al.
6,627,562 B1 * 9/2003 Gehring, Jr. ..... 442/35
6,644,070 B2 * 11/2003 Ikenaga et al. ..... 66/196
6,647,550 B1 11/2003 Matsuzaki et al.
6,699,803 B2 * 3/2004 Muirhead ..... 442/2
6,726,641 B2 4/2004 Chiang et al.
6,728,969 B2 * 5/2004 Zeiler ..... 2/4
6,737,160 B1 * 5/2004 Full et al. ..... 428/397
6,754,910 B2 6/2004 Shultz et al.
6,755,052 B1 * 6/2004 Sytz ..... 66/196
6,758,068 B2 * 7/2004 Shirasaki et al. ..... 66/195
6,872,439 B2 * 3/2005 Fearing et al. ..... 428/99
6,880,268 B2 * 4/2005 Chen ..... 36/43
6,972,269 B1 * 12/2005 Beretta ..... 442/1
6,990,686 B2 1/2006 Palmer
7,080,412 B2 * 7/2006 Zeiler ..... 2/4
7,090,651 B2 8/2006 Chiang et al.
7,213,421 B2 * 5/2007 Shirasaki et al. ..... 66/193
7,234,170 B2 6/2007 Simic
7,234,171 B2 * 6/2007 Rowe et al. ..... 2/114
7,235,504 B2 * 6/2007 Shirasaki et al. ..... 442/314
7,240,522 B2 * 7/2007 Kondou et al. ..... 66/195
7,338,685 B2 * 3/2008 Sano ..... 427/208.6
7,380,421 B1 * 6/2008 Liu ..... 66/196
7,410,682 B2 * 8/2008 Abrams ..... 428/90
7,428,772 B2 * 9/2008 Rock ..... 28/159
7,565,821 B2 * 7/2009 Park et al. ..... 66/195
7,581,258 B2 * 9/2009 Baron et al. ..... 2/69
7,653,948 B2 * 2/2010 Schwenner ..... 2/69
7,779,654 B2 * 8/2010 Garus ..... 66/195
7,811,272 B2 * 10/2010 Lindsay et al. ..... 604/389
8,070,705 B2 * 12/2011 Goodwin ..... 602/60
8,220,072 B2 7/2012 Dodd
8,336,117 B2 * 12/2012 Carter et al. ..... 2/87
8,661,564 B2 3/2014 Dodd
8,898,820 B2 12/2014 Sokolowski et al.
9,352,531 B2 5/2016 Berns et al.
2001/0008672 A1 * 7/2001 Norvell et al. ..... 428/90
2002/0100581 A1 * 8/2002 Knowles et al. ..... 165/185
2002/0104335 A1 * 8/2002 Shirasaki et al. ..... 66/196

(56) References Cited

U.S. PATENT DOCUMENTS

| | | | | |
|---|---|---|---|---|
| 2002/0124293 | A1* | 9/2002 | Zeiler | 2/4 |
| 2002/0157429 | A1* | 10/2002 | Matsumoto | 66/195 |
| 2002/0162161 | A1* | 11/2002 | Zeiler | 2/456 |
| 2003/0044569 | A1* | 3/2003 | Kacher et al. | 428/100 |
| 2003/0101776 | A1* | 6/2003 | Shirasaki et al. | 66/196 |
| 2003/0114782 | A1 | 6/2003 | Chiang et al. | |
| 2003/0115663 | A1* | 6/2003 | Turner et al. | 2/459 |
| 2003/0124312 | A1* | 7/2003 | Autumn | 428/141 |
| 2003/0181882 | A1 | 9/2003 | Toyoshima et al. | |
| 2003/0203691 | A1* | 10/2003 | Fenwick et al. | 442/327 |
| 2004/0009353 | A1* | 1/2004 | Knowles et al. | 428/411.1 |
| 2004/0033743 | A1* | 2/2004 | Worley et al. | 442/59 |
| 2005/0136762 | A1 | 6/2005 | Norvell et al. | |
| 2005/0142971 | A1* | 6/2005 | Chen et al. | 442/205 |
| 2005/0148984 | A1* | 7/2005 | Lindsay et al. | 604/387 |
| 2005/0208859 | A1* | 9/2005 | Baron et al. | 442/414 |
| 2005/0210570 | A1 | 9/2005 | Gameau | |
| 2007/0015427 | A1* | 1/2007 | Yanagawase et al. | 442/366 |
| 2008/0168591 | A1 | 7/2008 | Feduzi et al. | |
| 2012/0174282 | A1 | 7/2012 | Newton et al. | |

FOREIGN PATENT DOCUMENTS

| | | | |
|---|---|---|---|
| GB | 1094893 | A | 12/1967 |
| GB | 1265002 | A | 3/1972 |
| WO | 97/34507 | A1 | 9/1997 |
| WO | 99/39038 | A1 | 8/1999 |

* cited by examiner

ARTICLE OF APPAREL WITH MATERIAL ELEMENTS HAVING A REVERSIBLE STRUCTURE

RELATED APPLICATION DATA

This application is a divisional of U.S. patent application Ser. No. 11/254,547 filed Oct. 19, 2005 and entitled "Article of Apparel with Material Elements Having a Reversible Structure." This prior application is entirely incorporated herein by reference.

BACKGROUND

Articles of apparel designed for use during athletic activities generally exhibit characteristics that enhance the performance or comfort of an individual. For example, apparel may incorporate an elastic textile that provides a relatively tight fit, thereby imparting the individual with a lower profile that minimizes wind resistance. Apparel may also be formed from a textile that wicks moisture away from the individual in order to reduce the quantity of perspiration that accumulates adjacent to the skin. Furthermore, apparel may incorporate materials that are specifically selected for particular environmental conditions, such as heat, cold, rain, and sunlight. Examples of various types of articles of apparel include shirts, headwear, coats, jackets, pants, underwear, gloves, socks, and footwear.

Material elements incorporated into articles of apparel are generally selected to impart various aesthetic and functional characteristics. The color, sheen, and texture of material elements may be considered when selecting aesthetic characteristics. Regarding functional characteristics, the drape, insulative properties, absorptivity, water-resistance, air-permeability, durability, and wear-resistance, for example, may be considered. The specific characteristics of the material elements that are incorporated into apparel are generally selected based upon the specific activity for which the apparel is intended to be used. A material element that minimizes wind resistance, for example, may be suitable for activities where speed is a primary concern. Similarly, a material element that reduces the quantity of perspiration that accumulates adjacent to the skin may be most appropriate for athletic activities commonly associated with a relatively high degree of exertion. Accordingly, the material elements forming articles of apparel may be selected to enhance the performance or comfort of individuals engaged in specific athletic activities.

Although a variety of material elements may be incorporated into articles of apparel, textiles form a majority of many articles of apparel. Textiles may be defined as any manufacture from fibers, filaments, or yarns characterized by flexibility, fineness, and a high ratio of length to thickness. Textiles generally fall into two categories. The first category includes textiles produced directly from webs of fibers or filaments by bonding, fusing, or interlocking to construct non-woven fabrics and felts. The second category includes textiles formed through a mechanical manipulation of yarn.

Yarn is the raw material utilized to form textiles in the second category and may be defined as an assembly having a substantial length and relatively small cross-section that is formed from at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed from a single filament or a plurality of individual filaments grouped together. Yarn may also include separate filaments formed from different materials, or the yarn may include filaments that are each formed from two or more different materials. Similar concepts also apply to yarns formed from fibers. Accordingly, yarns may have a variety of configurations that generally conform to the definition provided above.

The various techniques for mechanically-manipulating yarn into a textile include interweaving, intertwining and twisting, and interlooping. Interweaving is the intersection of two yarns that cross and interweave at substantially right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping.

SUMMARY

One aspect of the invention is an article of apparel at least partially formed from a material element that includes a substrate and a plurality of projections. The substrate has a first surface and an opposite second surface. The projections extend from the first surface of the substrate, and the projections each have terminal ends located opposite the substrate. The material element has a first permeability when the first surface has a convex configuration, and the material element has a second permeability when the first surface has a concave configuration, the first permeability being greater than the second permeability.

Another aspect of the invention is an article of apparel having a first material element and a second material element. The first material element has a substrate with a first surface and an opposite second surface, and the first material element has a plurality of projections extending from the first surface of the substrate. The second material element is positioned adjacent the first material element and joined to the first material element to define a seam between edges of the first material element and the second material element. The article of apparel is convertible between a first configuration and a second configuration. The first surface faces outward from the article of apparel in the first configuration, and the second surface faces outward from the article of apparel in the second configuration. The seam between edges of the first material element and the second material element is structured to exhibit a finished structure in both the first configuration and the second configuration.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

BRIEF DESCRIPTION OF THE DRAWINGS

The foregoing Summary, as well as the following Detailed Description, will be better understood when read in conjunction with the accompanying drawings.

DETAILED DESCRIPTION

The following material and accompanying figures discloses various articles of apparel. Properties of the articles of apparel at least partially depend upon the orientation of material elements forming the articles of apparel. More particularly, the material elements have variable properties that depend upon whether a particular surface of the material elements faces inward (i.e., toward a wearer) or outward (i.e., away from the wearer). The variable properties include, for example, the degree of air-permeability, water-permeability, and light-permeability. Although the articles of apparel are disclosed as a shirt and a jacket, the concepts disclosed herein may be applied to a variety of apparel types, including headwear, coats, pants, underwear, gloves, socks, and footwear, for example.

Figure 1:
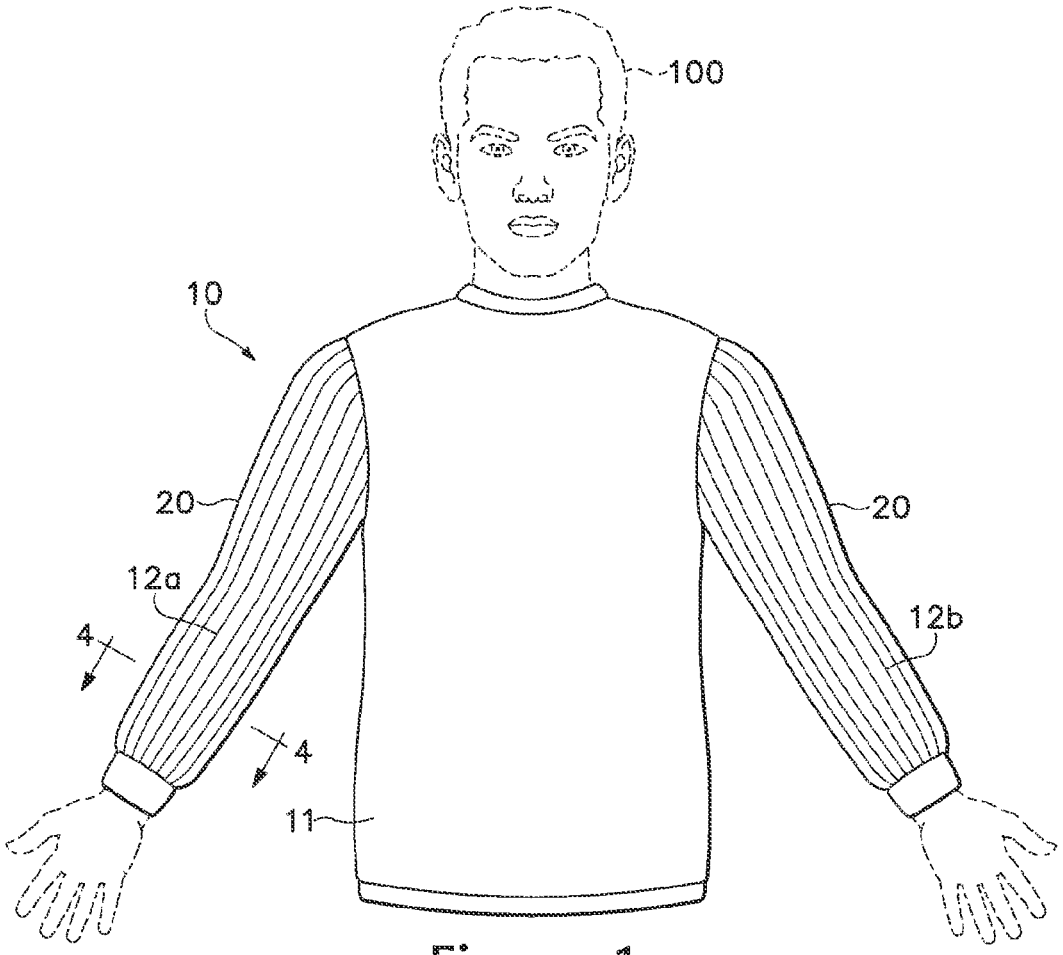
FIG. 1 is a front elevational view of a first article of apparel in accordance with various aspects of the invention.

An article of apparel 10 is depicted in FIG. 1 as having the general configuration of a long-sleeved shirt that is worn by an individual 100 (shown in dashed lines). Apparel 10 includes a torso region 11 and a pair of arm regions 12*a* and 12*b*. Torso region 11 corresponds with a torso of individual 100 and, therefore, covers the torso when worn. Arm regions 12*a* and 12*b* respectively correspond with a right arm and a left arm of individual 100 and, therefore, cover the right arm and the left arm when worn. In contrast with a conventional long-sleeved shirt, arm regions 12*a* and 12*b* are at least partially formed from a material element 20. In further embodiments torso region 11 may also incorporate material element 20.

Figure 2:
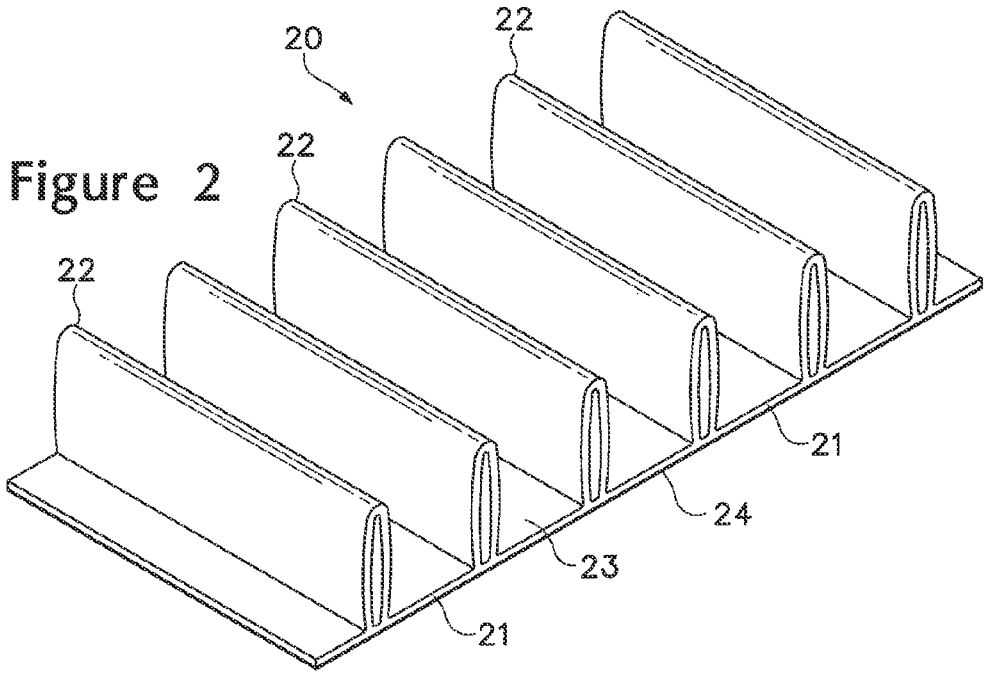
FIG. 2 is a perspective view of a portion of a material element of the first article of apparel.
Figure 3:
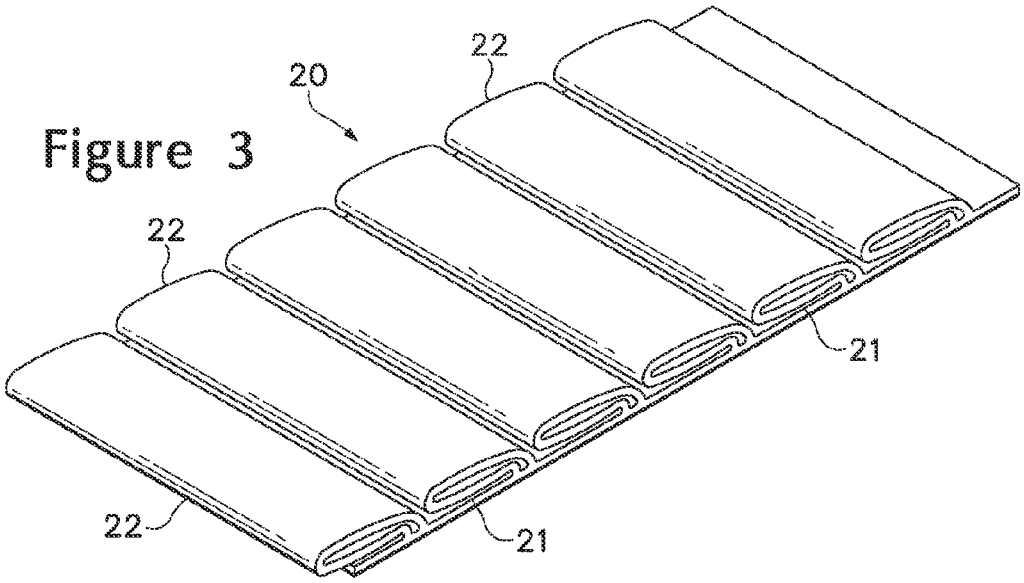
FIG. 3 is an alternate perspective view of the portion of the material element depicted in FIG. 2.

The primary components of material element 20, as depicted in FIGS. 2 and 3, are a substrate 21 and a plurality of projections 22 that extend from substrate 21. Substrate 21 is a generally planar portion of material element 20 and defines a first surface 23 and an opposite second surface 24. Projections 22 extend from first surface 23 and exhibit a structure of a plurality of elongate and parallel fins that extend across material element 20. Material element 20 may be formed as a textile by mechanically-manipulating one or more yarns to form the structure discussed above. Although substrate 21 and projections 22 may be formed separate from each other and subsequently secured together, material element 20 is depicted in a configuration wherein substrate 21 and projections 22 are formed of unitary construction (i.e., one-piece construction) from the mechanically-manipulated yarn. That is, substrate 21 and projections 22 may be formed as a one-piece element through a single knitting process, for example. Material element 20 may be formed, for example, through a process wherein a double knit knitting machine arranges yarn placement, and front and back needles do not knit at the same time, but join at one point to form projections 22. When manufactured through this process, substrate 21 is formed from a single layer of material and each of projections 22 are formed from two layers of material, as depicted in FIGS. 2 and 3. A single knit knitting machine may also be utilized.

The permeability of material element 20 to air, water, and light, for example, is at least partially dependent upon the relative positions of substrate 21 and projections 22. With reference to FIG. 2, a first configuration of material element 20 is depicted, in which projections 22 extend outward from substrate 21 and are oriented perpendicular to substrate 21. When projections 22 extend outward from substrate 21, material element 20 exhibits a relatively high degree of permeability because air, water, and light pass through only substrate 21 in order to permeate or otherwise pass through material element 20. In this configuration, therefore, the effective permeability of material element 20 is the permeability of substrate 21.

In contrast with the first configuration discussed above, FIG. 3 depicts a second configuration of material element 20, in which projections 22 lay adjacent to substrate 21 and are oriented parallel to substrate 21. When projections 22 lay adjacent to substrate 21, material element 20 exhibits a relatively low degree of permeability because air, water, and light pass through both substrate 21 and projections 22 in order to permeate or otherwise pass through material element 20. In this configuration, therefore, the overall permeability of material element 20 is a combination of the permeabilities of substrate 21 and projections 22.

Based upon the above discussion, the orientation of projections 22 relative to substrate 21 has an effect upon the permeability of material element 20. Additionally, material element 20 may be formed as a textile from mechanically manipulated yarn. Material element has, therefore, a flexible structure that converts between the first configuration (i.e., projections 22 extending outward from substrate 21) and the second configuration (i.e., projections 22 laying adjacent to substrate 21). Accordingly, individual 100 or another individual wearing apparel 10 may selectively convert material element 20 between the first configuration and the second configuration to enhance or limit the permeability of material element 20.

Factors that determine whether material element 20 is in the first configuration or the second configuration include the preferences of individual 100, the specific activity that individual 100 engages in, or the environmental conditions around individual 100, for example. If individual 100 prefers that article of apparel 10 provide a lesser degree of heat retention, then material element 20 may be converted to the first configuration wherein projections 22 extending outward from substrate 21, thereby permitting heated air to freely escape through material element 20. Conversely, if individual 100 prefers that article of apparel 10 provide a greater degree of heat retention, then material element 20 may be converted to the second configuration retain heated air within material element 20. During activities that cause individual 100 to perspire, such as exercise or athletic activities, material element 20 may be converted to the first configuration so as to allow air to pass into apparel 10 and perspiration to pass out of apparel 10. More particularly, apparel 10 may be configured such that projections 22 extend outward from substrate 21 and are oriented perpendicular to substrate 21. Also, during times of rain or other forms of precipitation, material element 20 may be converted to the second configuration so as to limit the quantity of precipitation that passes into apparel 10. Accordingly, various factors may be considered when determining whether material element 20 should exhibit the first configuration or the second configuration.

Various structures and methods may be utilized to retain material element 20 in one of the first configuration (i.e., projections 22 extending outward from substrate 21) and the second configuration (i.e., projections 22 laying adjacent to substrate 21). For example, relatively stiff fibers may extend into projections 22, and the angle of the fibers relative to substrate 21 will determine the resulting orientation of projections 22. Additionally, opposite sides of projections 22 may be formed from different materials to bias the orientation of projections 22. In some situations, threads or other members may extend through one or both of projections 22 to secure the relative positions of projections 22 and substrate 21. Adhesives or melt-bonding may also be utilized to determine the resulting orientation of projections 22. Furthermore, various memory materials that change shape based upon changes in temperature may be incorporated into projections 22, and the memory materials may be configured to extend projections 22 outward once the temperature of material element 20 increases above a predetermined temperature.

In order to ensure that the permeability of material element 20 is a combination of the permeabilities of substrate 21 and projections 22 when material element 20 is in the second configuration, a height dimension of projections 22 may be at least equal to a spacing dimension between projections 22 that are adjacent to each other. That is, the permeability of material element 20 may be decreased by forming projections 22 to have a height that is at least equal to a distance between projections 22 that are adjacent to each other. In this configuration, a terminal end of one projection abuts or is adjacent to a base of an adjacent projection when projections 22 lay adjacent to substrate 21. When lesser permeability is desired, however, projections 22 may have a height that is less than the distance between projections 22.

Figure 4A:
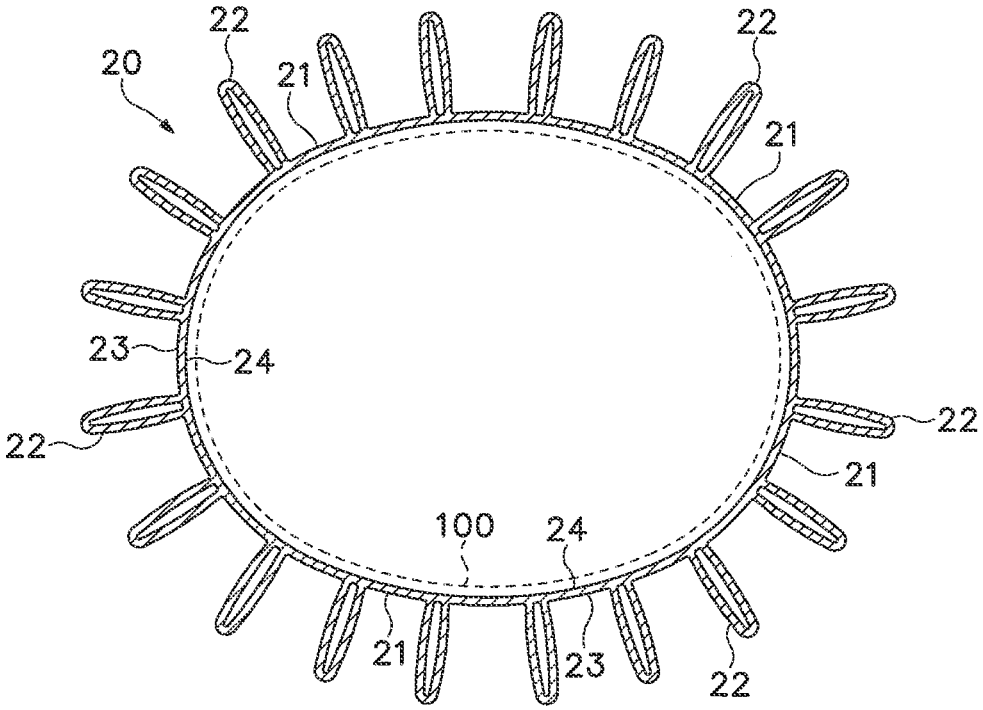
FIG. 4A is a cross-sectional view of the first article of apparel, as defined by section line 4-4 in FIG. 1.

FIG. 4A depicts a cross-section through arm region 12*a* of apparel 10 in which projections 22 are located on an exterior of apparel 10. More particularly, material element 20 is oriented such that first surface 23 (i.e., the surface from which projections 22 extend) faces outward and away from an interior of apparel 10, and second surface 24 faces inward and forms a surface that contacts individual 100. As depicted, many of projections 22 extend outward from substrate 21 so as to be oriented perpendicular to substrate 21. That is, most of material element 20 is in the first configuration. In the areas where projections 22 extend outward from substrate 21, the effective permeability of material element 20 is the permeability of substrate 21, thereby configuring apparel 10 to have a relatively high degree of permeability.

Figure 4B:
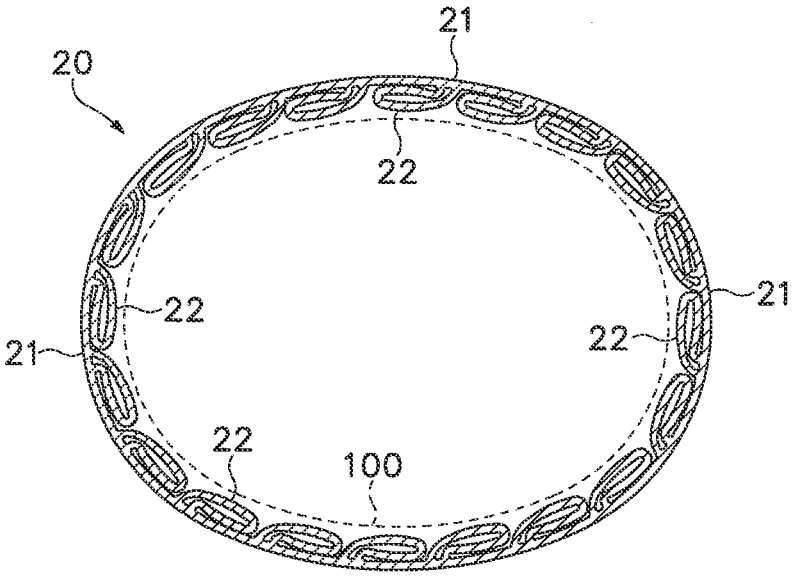
FIG. 4B is an alternate cross-sectional view corresponding with FIG. 4A.

As a comparison to FIG. 4A, FIG. 4B also depicts a cross-section through arm region 12*a* of apparel 10 in which projections 22 are located on an interior of apparel 10. More particularly, material element 20 is oriented such that first surface 23 faces inward to place projections 22 in a position that contacts individual 100, and second surface 24 faces outward to form an exterior surface of apparel 10. As depicted, many of projections 22 lay adjacent to substrate 21 so as to be oriented parallel to substrate 21. More particularly, many of projections 22 are compressed between individual 100 and substrate 21 in order to place most of material element 20 in the second configuration. In this second configuration, the overall permeability of material element 20 is a combination of the permeabilities of substrate 21 and projections 22, thereby configuring apparel 10 to have a relatively low degree of permeability.

Based upon the above discussion, one manner of converting material element 20 between the first configuration and the second configuration involves turning apparel 10 inside-out or otherwise changing the surface of apparel 10 that faces outward. When individual 100 prefers that apparel 10 (and specifically material element 20) exhibit high permeability to air, water, and light, then apparel 10 may be worn such that first surface 23 and projections 22 are on an exterior of apparel 10 and face outward. Conversely, when individual 100 prefers that apparel 10 (and specifically material element 20) exhibit low permeability to air, water, and light, then apparel 10 may be worn such that first surface 23 and projections 22 are on an interior of apparel 10 and face inward.

Another manner of converting material element 20 between the first configuration and the second configuration involves placing material element 20 in tension. In some configurations for material element 20, projections 22 may lay adjacent substrate 21 when material element 20 is not in tension. That is, material element 20 may be in the first configuration when not tensioned. When material element 20 is placed in tension, either along projections 22 or perpendicular to projections 22, projections 22 may stand upward to convert material element 20 to the second configuration. Elastic elements around wrist openings of apparel 10, for example, may be used to hold arm regions 12*a* and 12*b* in either the tensioned or untensioned state.

Figure 5:
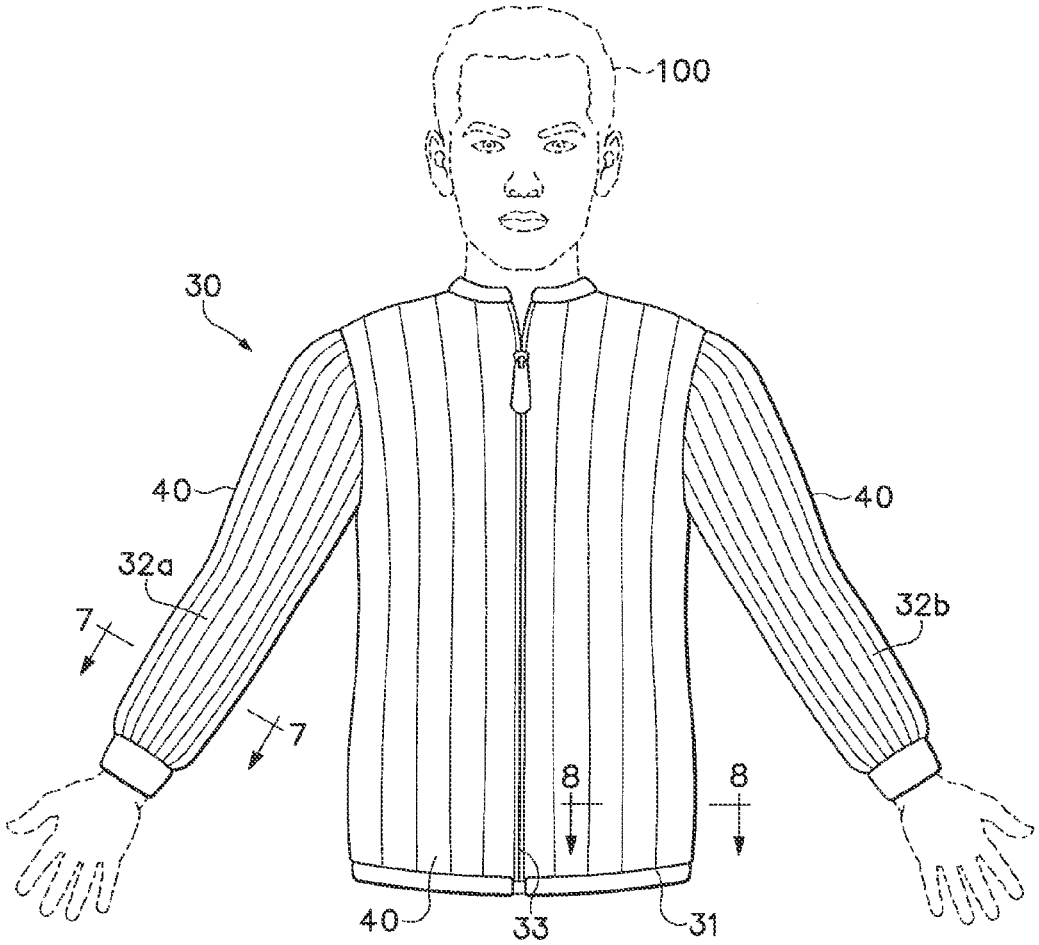
FIG. 5 is a front elevational view of a second article of apparel in accordance with various aspects of the invention.

Another article of apparel 30 is depicted in FIG. 5 as having the general configuration of a jacket that is worn by individual 100 (shown in dashed lines). Apparel 30 includes a torso region 31 and a pair of arm regions 32*a* and 32*b*. Torso region 31 corresponds with a torso of individual 100 and, therefore, covers the torso when worn. Arm regions 32*a* and 32*b* respectively correspond with a right arm and a left arm of individual 100 and, therefore, cover the right arm and the left arm when worn. Apparel 30 also includes a zipper 33 that extends vertically through torso region 31. In contrast with a conventional jacket, each of torso region 31 and arm regions 32*a* and 32*b* are at least partially formed from a material element 40.

Figure 6:
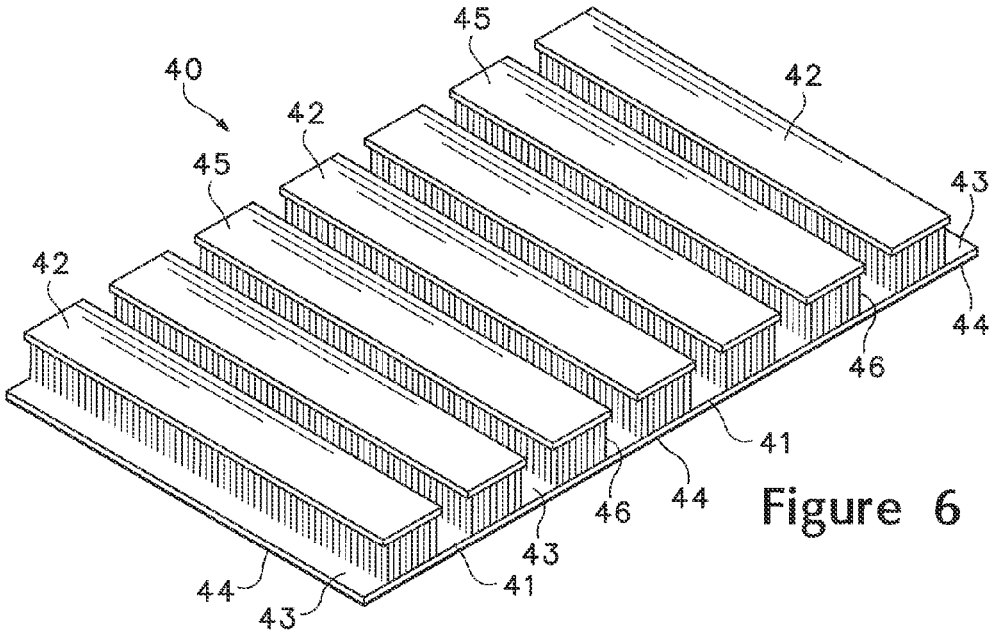
FIG. 6 is a perspective view of a portion of a material element of the second article of apparel.

The primary components of material element 40, as depicted in FIG. 6, are a substrate 41 and a plurality of projections 42 that extend from substrate 41. Substrate 41 is a generally planar portion of material element 40 and defines a first surface 43 and an opposite second surface 44. Projections 42 extend from first surface 43 and exhibit a structure of a plurality of elongate and parallel fins that extend across material element 40. Projections 42 are each formed from an end 45 and a plurality of connecting fibers 46 extending adjacent and parallel to each other. End 45 has the general configuration of a textile sheet, and connecting fibers 46 extend between end 45 and substrate 41 to space end 45 and substrate 41 away from each other.

Material element 40 may be formed as a textile by mechanically-manipulating one or more yarns or fibers to form the structure discussed above. More particularly, material element 40 may be formed to exhibit a configuration of a spacer knit fabric formed through a double needle bar raschel knitting process, for example. That is, substrate 41 and projections 42 may be formed as a one-piece element through a single knitting process.

Figure 7A:
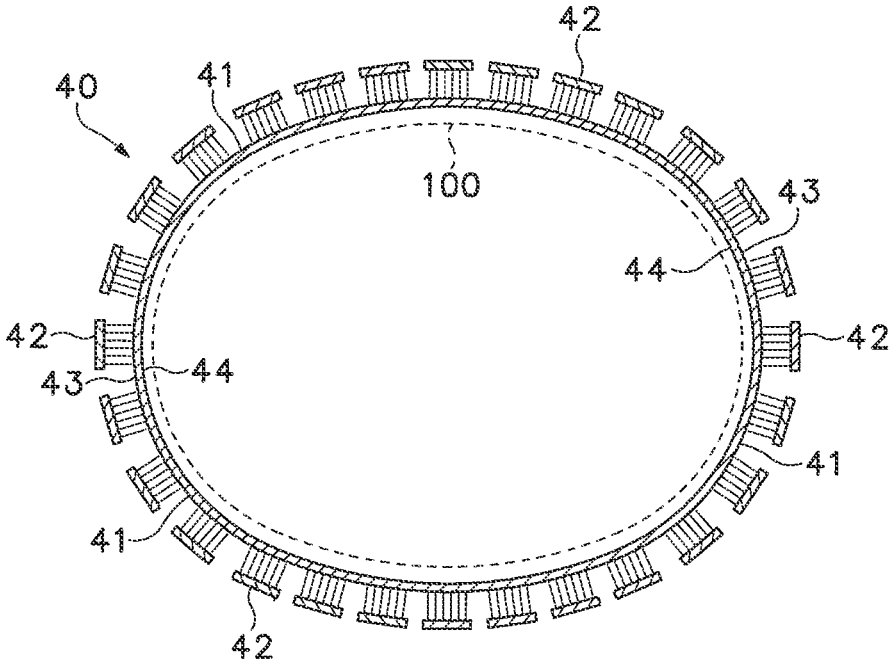
FIG. 7A is a cross-sectional view of the second article of apparel, as defined by section line 7-7 in FIG. 5.

The permeability of material element 40 to air, water, and light, for example, is at least partially dependent upon the curvature of substrate 41. FIG. 7A depicts a cross-section through arm region 32*a* of apparel 30 in which projections 42 are located on an exterior of apparel 30. More particularly, material element 40 is oriented such that first surface 43 (i.e., the surface from which projections 42 extend) faces outward and away from an interior of apparel 30, and second surface 44 faces inward and forms a surface that contacts individual 100. In this configuration, first surface 43 has a convex shape and spaces are formed between various projections 42. When projections 42 are spaced from each other, material element 40 exhibits a relatively high degree of permeability because air, water, and light may pass through only substrate 41 in order to permeate or otherwise pass through material element 40. In this configuration, therefore, the effective permeability of material element 40 is the permeability of substrate 41.

Figure 7B:
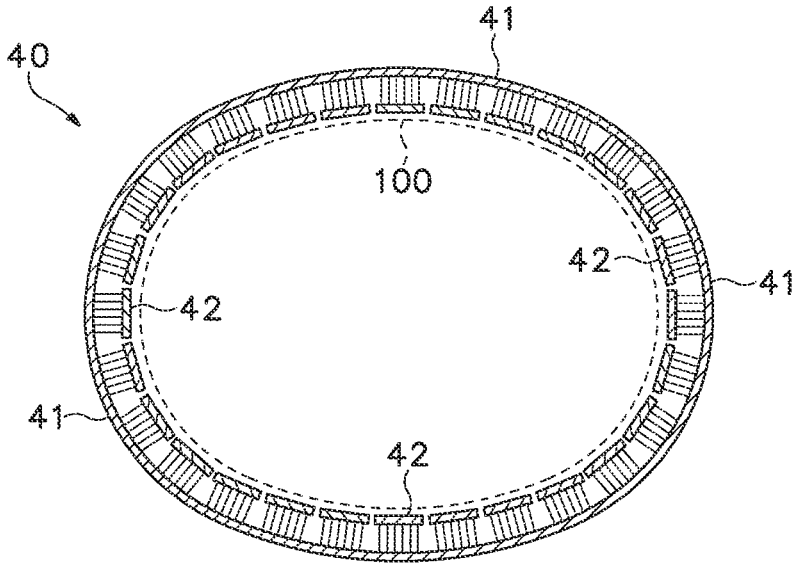
FIG. 7B is an alternate cross-sectional view corresponding with FIG. 7A.

As a comparison to FIG. 7A, FIG. 7B also depicts a cross-section through arm region 32*a* of apparel 30 in which projections 42 are located on an interior of apparel 30. More particularly, material element 40 is oriented such that first surface 43 faces inward to place ends 45 of projections 42 in a position that contacts individual 100, and second surface 44 faces outward to form an exterior surface of apparel 30. In this configuration, first surface 43 has a concave shape and the various projections 42 abut or otherwise contact each other. When projections 42 abut each other, material element 40 exhibits a relatively low degree of permeability because air, water, and light pass through each of substrate 41 and projections 42 in order to permeate or otherwise pass through material element 40. In this configuration, therefore, the effective permeability of material element 40 is a combination of the permeabilities of substrate 41 and projections 42, thereby configuring apparel 30 to have a relatively low degree of permeability.

Another manner of considering the difference between the configurations of FIGS. 7A and 7B relates to the distances between ends 45 of projections 42. In FIG. 7A, ends 45 are located further away from each other than in FIG. 7B, thereby forming the spaces between projections 42. Accordingly, a spacing dimension between ends 45 is a first distance when first surface 43 faces outward, and the spacing dimension between ends 45 is a second distance when second surface 44 faces outward, the first distance being greater than the second distance.

The curvature of substrate 41 (or the corresponding distance between ends 45) has an effect upon the permeability of material element 40, as discussed above. When first surface 43 has a convex configuration, as when facing outward from apparel 30, material element 40 has a relatively high degree of permeability to air, water, and light because of spaces that are formed between projections 42. When first surface 43 has a concave configuration, as when facing inward, material element 40 has a relatively low degree of permeability to air, water, and light due to the abutting nature of projections 42. Accordingly, individual 100 or another individual wearing apparel 30 may selectively convert material element 40 between the configuration of FIG. 7A and the configuration of FIG. 7B to enhance or limit the permeability of material element 40.

Based upon the above discussion, one manner of modifying the permeability of material element 40 involves turning apparel 30 inside-out or otherwise changing the surface of apparel 30 that faces outward. When individual 100 prefers that apparel 30 (and specifically material element 40) exhibit high permeability to air, water, and light, then apparel 30 may be worn such that first surface 43 and projections 42 are on an exterior of apparel 30 and face outward. Conversely, when individual 100 prefers that apparel 30 (and specifically material element 40) exhibit low permeability to air, water, and light, then apparel 30 may be worn such that first surface 43 and projections 42 are on an interior of apparel 30 and face inward.

Figure 8A:
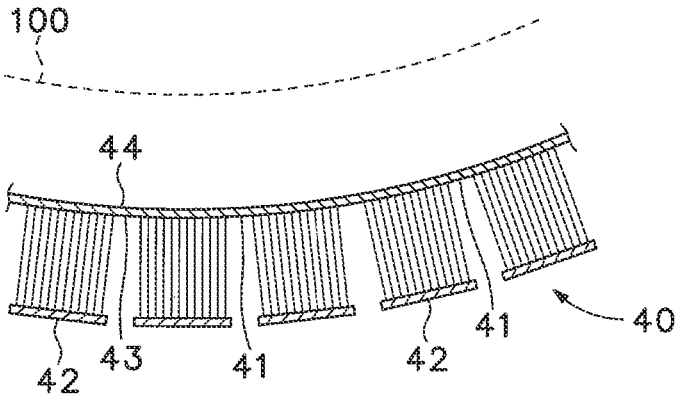
FIG. 8A is a fragmentary cross-sectional view of the second article of apparel, as defined by section line 8-8 in FIG. 5.
Figure 8B:
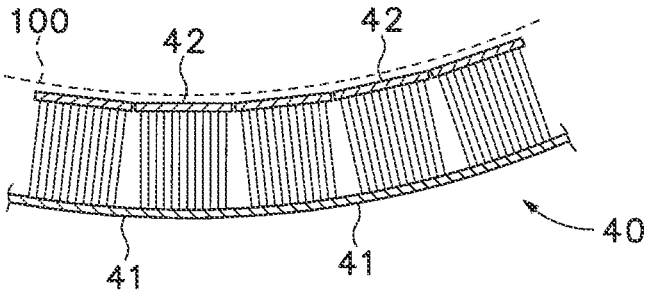
FIG. 8B is an alternate cross-sectional view corresponding with FIG. 8A.

FIGS. 8A and 8B depict cross-sections through torso region 31 in which projections 42 are respectively located on an exterior or an interior of apparel 30. As with FIGS. 7A and 7B, the curvature of substrate 41 has an effect upon whether spaces are formed between projections 42. More particularly, when first surface 43 has a convex configuration, spaces are formed between projections 42 to increase the permeability of material element 40. When first surface 43 has a concave configuration, however, projections 42 abut each other to decrease the permeability of material element 40.

The degree of curvature of arm regions 32*a* and 32*b* is greater than the degree of curvature in torso region 31. One skilled in the relevant art will recognize that the degree of curvature in material element 40 affects the spacing between projections 42. In FIGS. 7A and 8A, a lesser curvature would result in lesser spacing between projections 42, and a greater curvature would result in greater spacing between projections 42. Similarly and with respect to FIGS. 7B and 8B, a lesser curvature would result in greater spacing between projections 42, and a greater curvature would result in lesser spacing between projections 42. Accordingly, a height dimension of projections 42 (i.e., a distance between first surface 43 and end 45) may be selected to ensure that projections 42 abut each other given the degree of curvature in various areas of apparel 30. Alternately, and as depicted in FIGS. 7A-8B, the height dimension of projections 42 in arm regions 32*a* and 32*b* may be less than the height dimension of projections 42 in torso region 31 to compensate for the lesser degree of curvature in torso region 31. That is, the height dimension of projections 42 may be greater in torso region 31 than in arm regions 32*a* and 32*b*.

Apparel 30 may be turned inside-out to modify the permeability of material element 40. In order to provide an aesthetically-acceptable appearance to apparel 30, seams between adjacent portions of material element 40 may be finished on both sides. That is, the portion of the seams that faces outward when projections 42 are on an exterior of apparel 30 may be structured to exhibit a finished structure, and the portion of the seams that faces outward when projections 42 are on the interior of apparel 30 may also be structured to exhibit a finished structure. Accordingly, apparel 30 will have a finished appearance whether projections 42 are on the interior or the exterior. Similar concepts may be applied to apparel 10 such that apparel 10 will have a finished appearance whether projections 22 are on the interior or the exterior.

Figure 9:
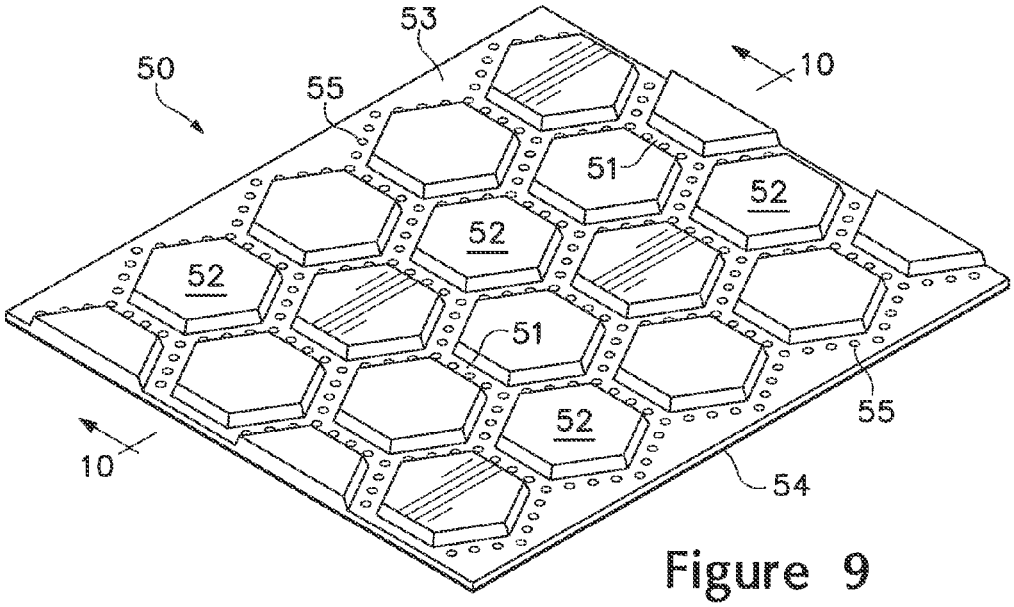
FIG. 9 is a perspective view of a material element in accordance with various aspects of the invention.
Figure 10A:
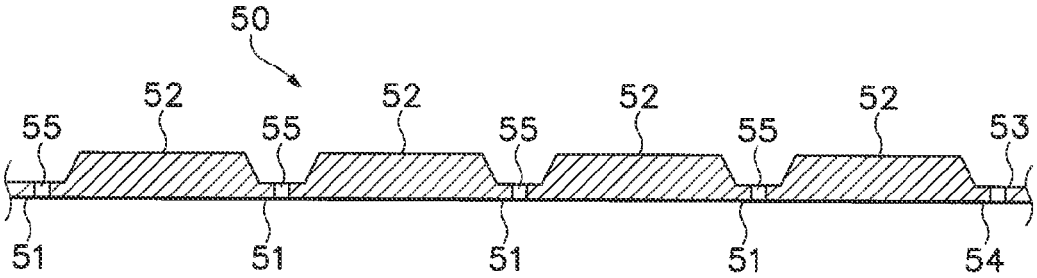
FIG. 10A is a cross-sectional view of the material element of FIG. 9, as defined by section line 10-10 in FIG. 9.

With reference to FIG. 9, another material element 50 is depicted as having a substrate 51 and a plurality of projections 52. As with material elements 20 and 40, material element 50 may be incorporated into various articles of apparel, such as apparel 10 and apparel 30. Substrate 51 is a generally planar portion of material element 50 and defines a first surface 53 and an opposite second surface 54. Projections 52 extend from first surface 53 and exhibit a structure of a plurality of hexagonal elements. Material element 50 may be formed as a non-woven textile that is embossed to form projections 52. That is, material element 50 may be embossed in areas between projections 52 to define projections 52. As depicted in FIGS. 9 and 10A, a plurality of apertures 55 having the form of holes through substrate 51 are formed in the embossed areas. In some embodiments, projections 52 may be formed separate from substrate 51 and subsequently secured to substrate 51.

Projections 52 have a hexagonal shape and are arranged to form a tessellation in material element 50. The hexagonal shape of projections 52 provides multiple directions of flex in material element 50. That is, material element 50 will flex along any of the sides of projections 52. As utilized herein, the term "tessellation" is defined as a covering of an area, without significant gaps or overlaps, by congruent plane figures of one type or a plurality of types. The hexagonal shapes of projections 52 fit together in a manner that leaves spaces between adjacent projections 52, but does not form significant gaps or overlaps. Accordingly, a uniform space between adjacent projections 52 is formed.

Figure 10B:
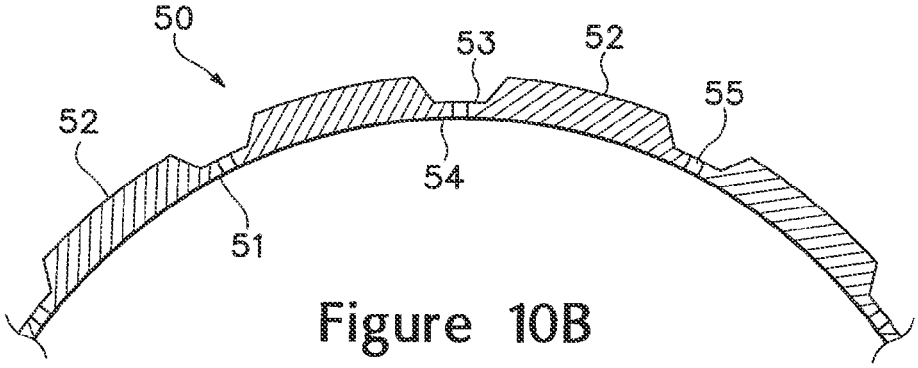
FIG. 10B is a modified cross-sectional view corresponding with FIG. 10A.
Figure 10C:
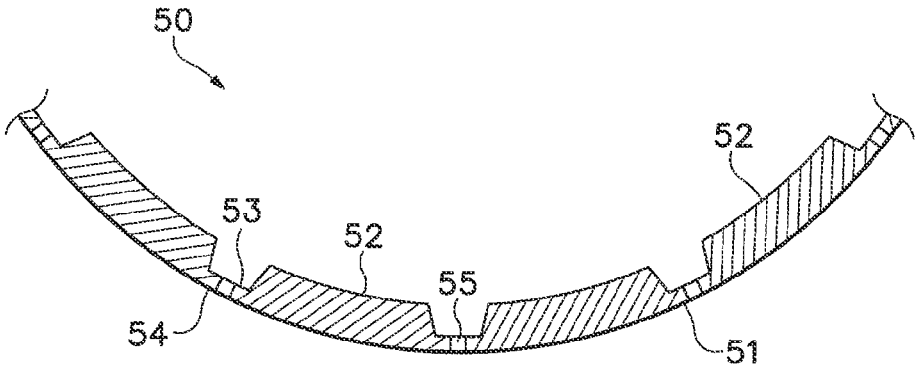
FIG. 10C is another modified cross-sectional view corresponding with FIG. 10A.
Figure 10D:
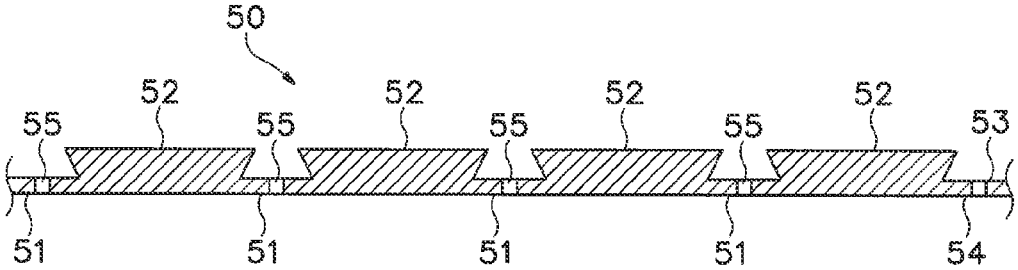
FIG. 10D is an alternate cross-sectional view of the material element of FIG. 9, as defined by section line 10-10 in FIG. 9.
Figure 10E:
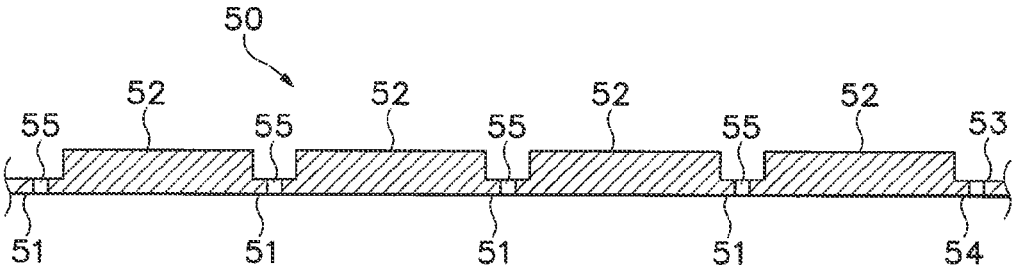
FIG. 10E is another alternate cross-sectional view of the material element of FIG. 9, as defined by section line 10-10 in FIG. 9.

With reference to FIGS. 10B and 10C, material element 50 is depicted in various curved configurations that modify the permeability of material element 50. In FIG. 10B, first surface 53 has a convex shape that maximizes the distance between adjacent projections 52. This configuration increases the permeability of material element 50 by exposing a plurality of apertures 55 that are located between adjacent projections 52. In FIG. 10C, however, first surface 53 has a concave shape that minimizes the distance between adjacent projections 52 and also minimizes the permeability of material element 50. If, for example, material element 50 exhibited greater curvature, permeability could be reduced further when side portions of projections 52 contact each other and effectively seal at least a portion of the plurality of apertures 55. In an alternate configuration, as depicted in FIG. 10D, the side portions of projections 52 exhibit a reverse angle such that a terminal end (i.e., surface furthest from substrate 51) of projections 52 has a greater area than a base. In yet another alternate configuration, as depicted in FIG. 10E, the side portions of projections 52 are oriented perpendicular to substrate 51.

Figure 11A:
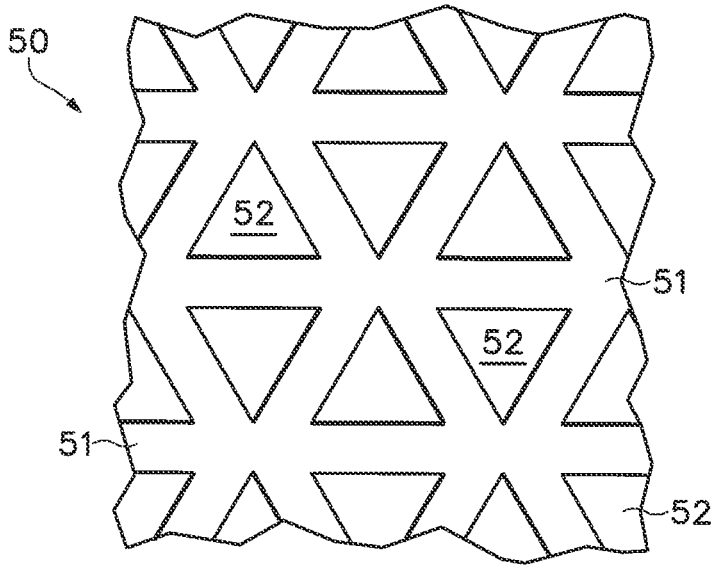
FIGS. 11A-11G depict alternate configurations for the material element of FIG. 9.
Figure 11B:
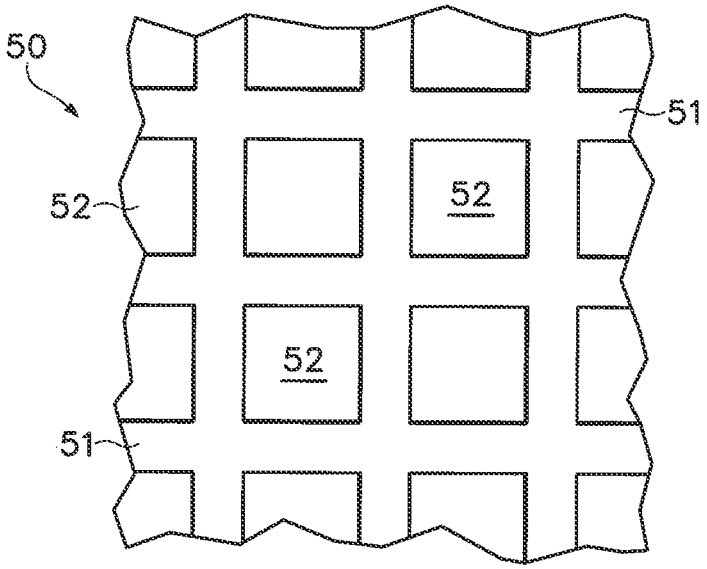

Although projections 52 may have the hexagonal shape discussed above, the shapes of projections 52 may vary significantly. Projections 52 may also exhibit triangular or square shapes, as depicted in FIGS. 11A and 11B. An advantage of the hexagonal, triangular, and square shapes relates to the manner in which the various projections 52 may be arranged. More particularly, projections 52 having hexagonal, triangular, or square shapes may be arranged to effectively form a tessellation in material element 50. Accordingly, projections 52 having hexagonal, triangular, or square shapes may be arranged such that edges of the various projections 52 are adjacent to edges of other projections 52 and few significant gaps are formed between projections 52.

Figure 11C:
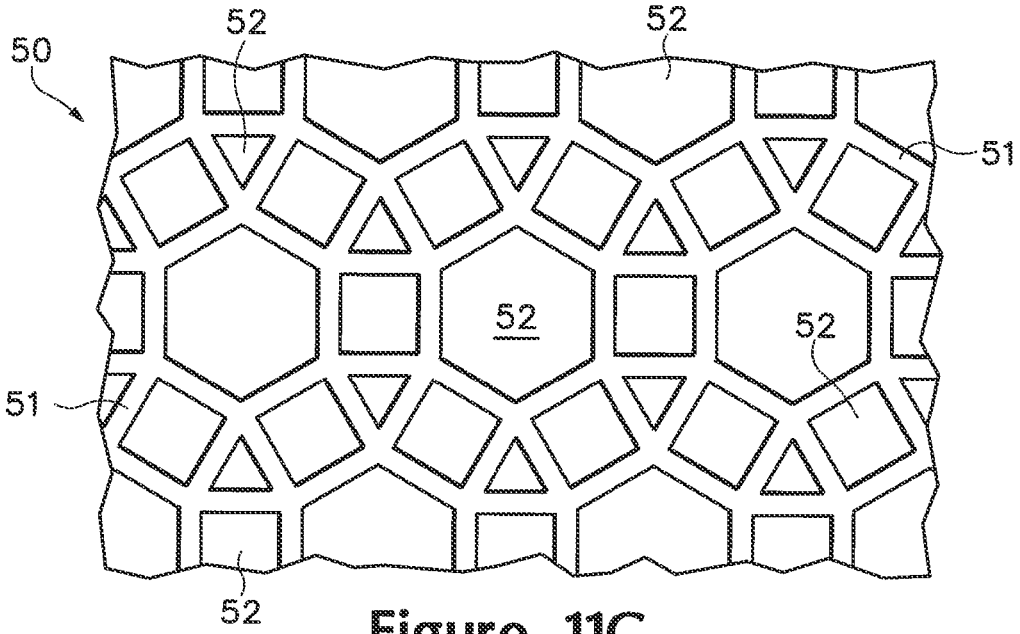
Figure 11D:
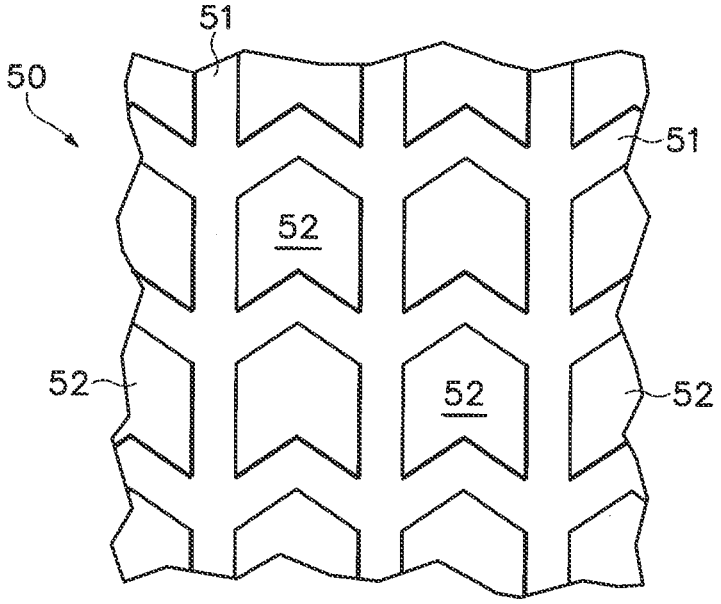
Figure 11E:
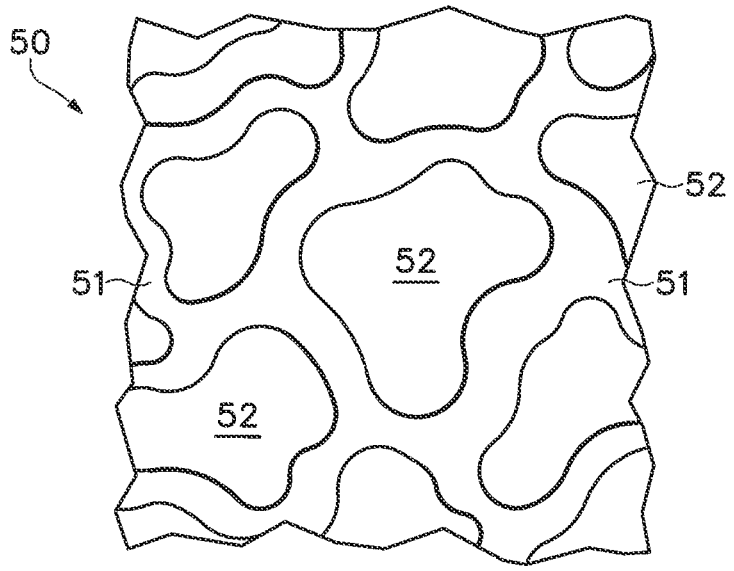
Figure 11F:
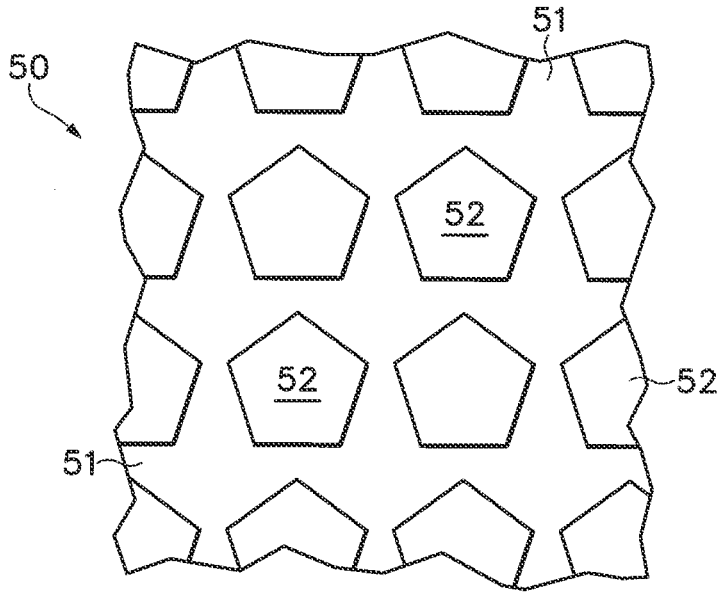
Figure 11G:
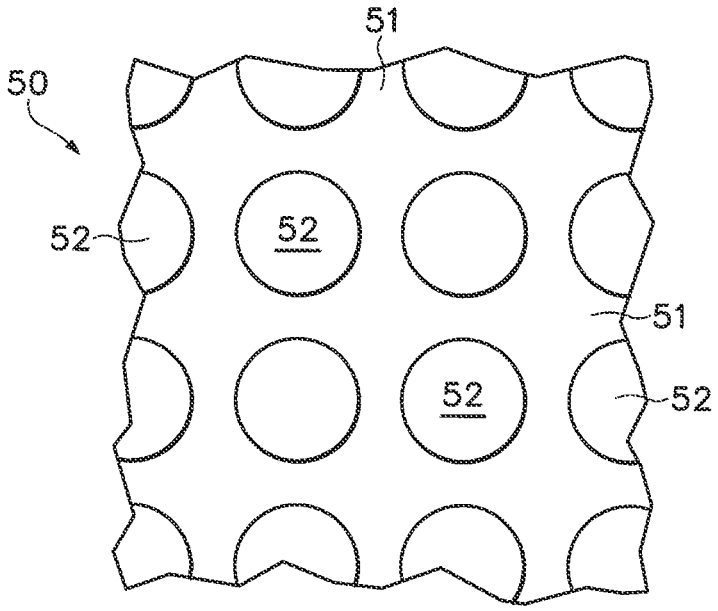

Projections 52 having other shapes may form a tessellation. Referring to FIG. 11C projections 52 having a mixture of hexagonal, triangular, and square configurations are arranged to form a tessellation. Projections 52 having a chevron configuration or an irregular configuration may also be arranged to form a tessellation, as depicted in FIGS. 11D and 11E. Accordingly, projections 52 may form a tessellation when exhibiting non-regular geometrical or non-geometrical configurations. In other embodiments, projections 52 may exhibit pentagonal or round configurations, as depicted in FIGS. 11F and 11G. Accordingly, projections 52 may exhibit a variety of configurations within the scope of the present invention.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. An article of apparel at least partially formed from a textile element, the textile element comprising:

a substrate with a first surface and an opposite second surface;

a first elongate projection extending from the first surface of the substrate, the first projection having a first terminal end located opposite the substrate, and the first projection having a first plurality of connecting fibers with adjacent connecting fibers extending parallel to each other and extending between the first terminal end and the substrate;

a second elongate projection extending from the first surface of the substrate adjacent but spaced from the first projection, the second projection having a second terminal end located opposite the substrate, and the second projection having a second plurality of connecting fibers extending between the second terminal end and the substrate; and a third elongate projection extending from the first surface of the substrate adjacent but spaced from the second projection and on a side of the second projection opposite from the first projection, the third projection having a third terminal end located opposite the substrate, and the third projection having a third plurality of connecting fibers extending between the third terminal end and the substrate, wherein the substrate and the first, second, and third elongate projections are a unitary knitted construction; and wherein the first, second, and third terminal ends each constitute a first textile sheet, a second textile sheet, and a third textile sheet that are not connected to each other.

2. The article of apparel recited in claim 1, wherein the textile element is a spacer material formed through a double needle bar raschel knitting process.

3. The article of apparel recited in claim 1, wherein height dimensions of the first and second projections are less than a spacing dimension between a central area of the first projection and a central area of the second projection adjacent to the first projection.

4. The article of apparel recited in claim 1, wherein the article of apparel is reversible to convert between the first surface facing outward and the second surface facing outward.

5. The article of apparel recited in claim 4, wherein a spacing dimension between the first and second terminal ends is a first distance when the first surface faces outward, and the spacing dimension between the first and second terminal ends is a second distance when the second surface faces outward, the first distance being greater than the second distance.

6. The article of apparel recited in claim 1, wherein the first, second, and third plurality of connecting fibers extend from their respective textile sheet to the substrate.

7. An article of apparel at least partially formed from a textile element, the textile element comprising:

a substrate with a first surface and an opposite second surface; and a plurality of elongate projections extending from the first surface of the substrate, the projections having terminal ends located opposite the substrate, and the projections each having a plurality of connecting fibers with adjacent connecting fibers extending parallel to each other and extending between a respective terminal end of the projection and the substrate, wherein the substrate and the plurality of elongate projections are a unitary knitted construction, and wherein each terminal end constitutes a plurality of textile sheets that are not connected to each other.

8. The article of apparel recited in claim 7, wherein the textile element is a spacer material formed through a double needle bar raschel knitting process.

9. The article of apparel recited in claim 7, wherein a height dimension of a projection of the plurality of elongate projections is less than a spacing dimension between a central area of each of the projections that are adjacent to each other.

10. The article of apparel recited in claim 7, wherein the article of apparel is reversible to convert between the first surface facing outward and the second surface facing outward.

11. The article of apparel recited in claim 10, wherein a spacing dimension between the terminal ends of two adjacent projections is a first distance when the first surface faces outward, and the spacing dimension between the terminal ends of these same two projections is a second distance when the second surface faces outward, the first distance being greater than the second distance.

12. The article of apparel recited in claim 7, wherein the plurality of connecting fibers extend from each individual textile sheet to the substrate.

* * * * *